US007607846B2

(12) United States Patent
Sawai et al.

(10) Patent No.: US 7,607,846 B2
(45) Date of Patent: Oct. 27, 2009

(54) EJECTION TRAY, SHEET SUPPLY AND EJECTION DEVICE, IMAGE FORMING APPARATUS, AND INFORMATION DISPLAY DEVICE

(75) Inventors: Kunihito Sawai, Kanagawa (JP); Yutaka Hasegawa, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/151,689

(22) Filed: May 8, 2008

(65) Prior Publication Data

US 2008/0217832 A1 Sep. 11, 2008

Related U.S. Application Data

(63) Continuation of application No. 11/193,104, filed on Jul. 25, 2005.

(30) Foreign Application Priority Data

Jul. 27, 2004 (JP) ..... 2004-218269

(51) Int. Cl.
*B41J 11/38* (2006.01)

(52) U.S. Cl. ..... 400/624; 400/691; 347/101; 347/104; 347/108; 348/375; 348/207.2

(58) Field of Classification Search ..... 400/691; 347/101, 104, 108; 348/375, 207.2
See application file for complete search history.

(56) References Cited

U.S. PATENT DOCUMENTS

| | | | | |
|---|---|---|---|---|
| 4,262,301 | A * | 4/1981 | Erlichman | 386/31 |
| 5,426,496 | A * | 6/1995 | Koike et al. | 399/381 |
| 5,662,320 | A * | 9/1997 | Fujiwara et al. | 271/3.14 |
| 6,356,357 | B1 * | 3/2002 | Anderson et al. | 358/1.17 |
| 6,550,910 | B2 * | 4/2003 | Hwang | 347/108 |
| 6,552,743 | B1 * | 4/2003 | Rissman | 348/207.2 |
| 2001/0030692 | A1 * | 10/2001 | Yoneda | 348/207 |
| 2003/0156200 | A1 * | 8/2003 | Romano et al. | 348/207.99 |
| 2004/0263632 | A1 * | 12/2004 | Kimura | 348/207.2 |

FOREIGN PATENT DOCUMENTS

JP 2000-036931 2/2000

* cited by examiner

*Primary Examiner*—Judy Nguyen
*Assistant Examiner*—Matthew G Marini
(74) *Attorney, Agent, or Firm*—Robert J. Depke; Rockey, Depke & Lyons, LLC

(57) ABSTRACT

An ejection tray includes a container that contains a plurality of stacked recording sheets printed by a printing unit of an image forming apparatus, a movable cover mounted on the container, and a sorting member that sorts out a desired recording sheet from the recording sheets stacked in the container. The desired recording sheet sorted out in the container is allowed to be taken out when the cover is opened.

2 Claims, 6 Drawing Sheets

EJECTION TRAY, SHEET SUPPLY AND EJECTION DEVICE, IMAGE FORMING APPARATUS, AND INFORMATION DISPLAY DEVICE

The subject matter of application Ser. No. 11/193,104, is incorporated herein by reference. The present application is a continuation of U.S. Ser. No. 11/193,104, filed Jul. 25, 2005, which claims priority to Japanese Patent Application No. JP2004-218269, filed Jul. 27, 2004. The present application claims priority to these previously filed applications.

CROSS REFERENCES TO RELATED APPLICATIONS

The present invention contains subject matter related to Japanese Patent Application JP 2004-218269 filed in the Japanese Patent Office on Jul. 27, 2004, the entire contents of which are incorporated herein by reference.

BACKGROUND OF THE INVENTION

1. Field of the Invention

The present invention relates to an ejection tray that contains printed recording sheets in an image forming apparatus, to a sheet supply and ejection device for recording sheets in an image forming apparatus, to an image forming apparatus such as a printer, a copying machine, or a facsimile apparatus, and to an information display device that allows viewing of various information displayed on a display. More particularly, the present invention relates to a technique that provides high space efficiency and excellent design and that allows printed recording sheets to be taken out easily.

2. Description of the Related Art

In general image forming apparatuses, for example, printers, copying machines, and facsimile apparatuses, recording sheets, such as cut sheets, contained in a supply tray are sequentially conveyed to a printing unit, such as an ink-jet head, so that printing is performed thereon. After printing, the recording sheets are ejected and stocked in an ejection tray.

Print data used for printing on recording sheets is acquired from an information acquisition unit, such as a personal computer or a digital camera, via various interfaces (RS232C, SCSI, IEEE1394, and USB), and is stored in a memory. Printing is performed on the recording sheets according to the stored print data.

Japanese Unexamined Patent Application Publication No. 2000-36931 discloses a printer to which a digital camera serving as an information acquisition unit can be detachably connected. This printer includes a connecting base to which a digital camera is connected to acquire print data. Printing is performed on recording sheets according to the print data acquired by the connecting base.

According to the technique disclosed in this publication, images are displayed on a liquid crystal display provided on the back side of the digital camera. When any of the images is selected to be printed, print data on the selected image is transferred to the printer, a cut sheet (recording sheet) is conveyed from a supply tray by supply rollers provided in the printer, and printing is performed thereon by a printing unit. After printing, the supply rollers are reversed to eject and stock the cut sheet in an ejection tray disposed on the supply tray.

However, this publication does not disclose how cut sheets are contained in the lower supply tray. Therefore, it is not clear how to add cut sheets into the supply tray.

Moreover, this publication does not disclose how cut sheets stocked in the upper ejection tray are taken out. Therefore, it is not clear how to take out a desired cut sheet from a stack of printed cut sheets in the ejection tray.

In addition, images to be printed are displayed only on the liquid crystal display of the digital camera, but are not displayed after the digital camera is detached from the printer. For this reason, it is difficult to check an image actually printed by the printer.

SUMMARY OF THE INVENTION

It is desirable to provide an ejection tray, a sheet supply and ejection device, and an image forming apparatus that allow recording sheets ejected on the ejection tray to be easily taken out even when the ejection tray is provided on a supply tray, and that allow recording sheets to be easily added into the supply tray. It is also desirable to provide an information display device that allows information printed on recording sheets to be easily checked later.

In order to overcome the above problems, an ejection tray according to an embodiment of the present invention includes a container that contains a plurality of stacked recording sheets printed by a printing unit of an image forming apparatus, a movable cover mounted on the container, and a sorting member that sorts the recording sheets stacked in the container. A desired recording sheet sorted out in the container is allowed to be taken out when the cover is opened.

The sorting member for sorting recording sheets is provided inside the container of the ejection tray. Therefore, a plurality of stacked recording sheets are sorted in the container, and a desired printed recording sheet can be easily taken out from the stack. Preferably, the sorting member holds, on a back side of the cover, all other recording sheets stacked on the desired recording sheet. With this sorting member, the desired recording sheet is placed at the uppermost position, and can be easily taken out by simply opening the cover.

A sheet supply and ejection device according to another embodiment of the present invention includes a supply tray for a recording sheet, and an ejection tray having a container that contains the recording sheet after printing, and a movable cover mounted on the container. The recording sheet supplied from the supply tray is subjected to printing by a printing unit of an image forming apparatus, and is then ejected into the container of the ejection tray. The ejection tray is separably disposed on the supply tray. Another recording sheet is allowed to be added into the supply tray by separating the supply tray and the ejection tray. The recording sheet contained in the container is allowed to be taken out by opening the cover.

An image forming apparatus according to a further embodiment of the present invention includes a printing unit for performing printing on a recording sheet, a supply tray for supplying the recording sheet, and an ejection tray having a container that contains the recording sheet after printing, and a movable cover mounted on the container. The recording sheet supplied from the supply tray is subjected to printing by the printing unit, and is then ejected into the container of the ejection tray. The ejection tray is separably disposed on the supply tray. Another recording sheet is allowed to be added into the supply tray when the supply tray and the ejection tray are separated. The recording sheet contained in the container is allowed to be taken out when the cover is opened.

That is, recording sheets can be added into the supply tray by simply separating the supply tray and the ejection tray placed one on the other.

An information display device according to a still further embodiment of the present invention includes a container that contains a recording sheet after printing, a movable cover mounted on the container, and a display for displaying information for inspection. The display displays an information image corresponding to information printed on the recording sheet by a printing unit of an image forming apparatus. The recording sheet contained in the container is allowed to be taken out when the cover is opened.

The display displays an information image corresponding to information printed by the printing unit of the image forming apparatus. By checking the information image displayed on the cover, information actually printed on the recording sheet in the container can be easily checked later.

The above embodiments of the present invention can be finally applied to the same apparatus (image forming apparatus), regardless of the name. That is, the ejection tray, the sheet supply and ejection device, or the information display device having a printing unit corresponds to the image forming apparatus. When a sorting member for sorting recording sheets is provided in the container of the sheet supply and ejection device, the image forming apparatus, or the information display device that contains printed recording sheets, a desired recording sheet can be easily taken out from the printed recording sheets, similarly to the ejection tray of the embodiment of the present invention.

When the ejection tray is provided on the supply tray so that a recording sheet supplied from the supply tray is bent, and is then ejected into the ejection tray, printing speed is increased because it is unnecessary to rotate supply rollers in reverse. When the printing unit is provided at one end of the trays, a planar outer shape is obtained, and high space efficiency and excellent design are provided. By placing an ink container for printing ink on the supply tray and the ejection tray one on another, high space efficiency and excellent design can be maintained. In this case, ink is added in a state in which the ink container is separated from the supply tray or the ejection tray.

The ejection tray, the sheet supply and ejection device, or the image forming apparatus having a display corresponds to the information display device. In this case, when the display has a touch panel function, recording sheets in the container can be sorted by simply selecting information images displayed on the display.

DESCRIPTION OF THE PREFERRED EMBODIMENTS

An embodiment of the present invention will be described below with reference to the drawings.

The ejection tray, the sheet supply and ejection device, the image forming apparatus, and the information display device in the embodiments of the present invention are used in the same apparatus (image forming apparatus) in the following embodiment. An ink-jet printer 10 corresponding to the image forming apparatus also corresponds to the information display device, a part (a container 13 and a cover 14) of the ink-jet printer 10 corresponds to the ejection tray, and the ejection tray and a supply tray 15 correspond to the sheet supply and ejection device.

Figure 1:
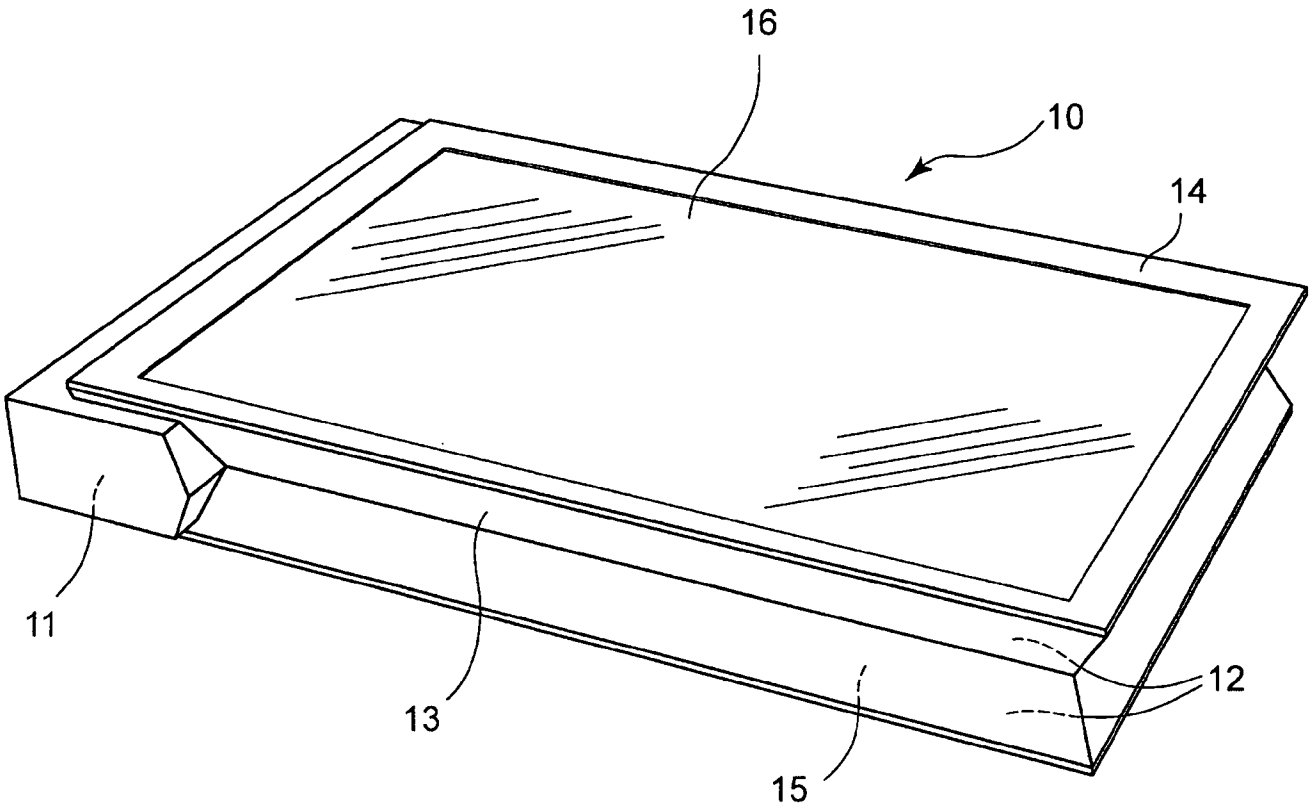
FIG. 1 is a perspective view of an ink-jet printer according to an embodiment of the present invention.

FIG. 1 is a perspective view of an ink-jet printer 10 according to this embodiment.

Referring to FIG. 1, the ink-jet printer 10 includes an ink-jet head 11 (corresponding to the printing unit), a container 13 that contains cut sheets 12 (corresponding to the recording sheets) on which printing is performed by the ink-jet head 11, a movable cover 14 mounted on the container 13, and a supply tray 15 from which the cut sheets 12 are supplied. The container 13 and the cover 14 constitute an ejection tray. A liquid crystal display 16 (corresponding to the display) is provided on the cover 14.

The ejection tray (container 13 and cover 14) is provided on the supply tray 15, and the ink-jet head 11 is provided at one end of the supply tray 15. Therefore, the ink-jet printer 10 has a planar outer shape that is one size larger than the cut sheets 12. This provides high space efficiency and excellent design.

Figure 2:
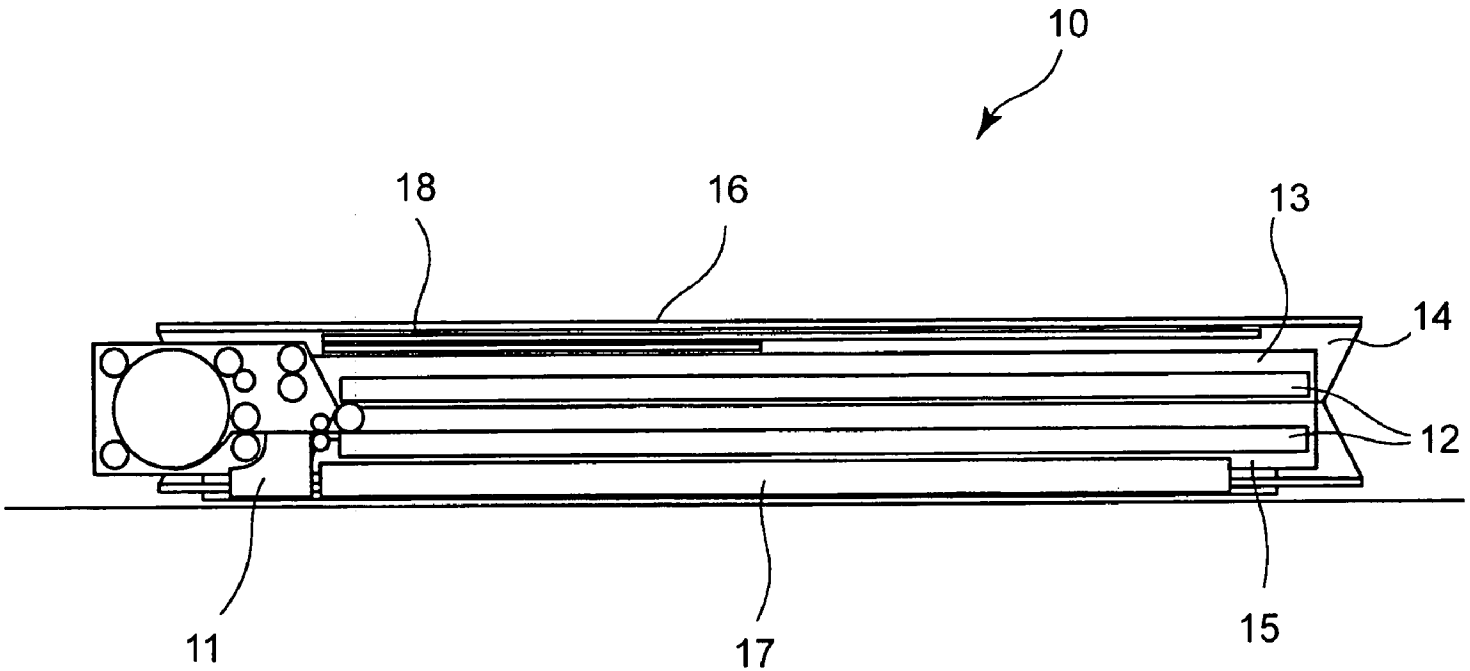
FIG. 2 is a cross-sectional view of the ink-jet printer.

FIG. 2 is a cross-sectional view of the ink-jet printer 10.

As shown in FIG. 2, cut sheets 12 are stacked in the supply tray 15. The cut sheets 12 are supplied one by one from the uppermost one while being nipped by supply rollers, and printing is performed thereon by the ink-jet head 11.

The ink-jet head 11 is a line head having a length correspondingly to the print width, and includes multiple heads arranged in the widthwise direction of the cut sheets 12. Therefore, it is possible to perform printing without moving the ink-jet head 11 in the widthwise direction of the cut sheets 12.

Inks of four colors, Y (yellow), M (magenta), C (cyan), and K (black) are supplied from an ink cartridge 17 (corresponding to the ink container) to the ink-jet head 11 so that printing can be performed on the cut sheets 12 with quality of color pictures. The ink cartridge 17 is provided under the supply tray 15. That is, three components, the ink cartridge 17, the supply tray 15, and the ejection tray (container 13 and cover 14), are stacked.

Data (for example, picture images) on printing on cut sheets 12 is sent from an information acquisition unit (not shown), such as a digital camera, in a wireless manner, is received by a receiver mounted on a control board 18, and is stored in a memory. The control board 18 also controls the display of information on the cover 15 by the liquid crystal display 16. Various interfaces (RS232C, SCSI, IEEE1394, and USB) may be provided on the control board 18 for wire connection to the information acquisition unit.

After printing is performed on a cut sheet 12 by the ink-jet head 11 according to the print data stored in the memory, the cut sheet 12 is ejected in a bent form by an ejection roller, and is placed in the container 13 with its print surface facing up. Subsequently printed cut sheets 12 are stacked in the container 13.

Figure 3:
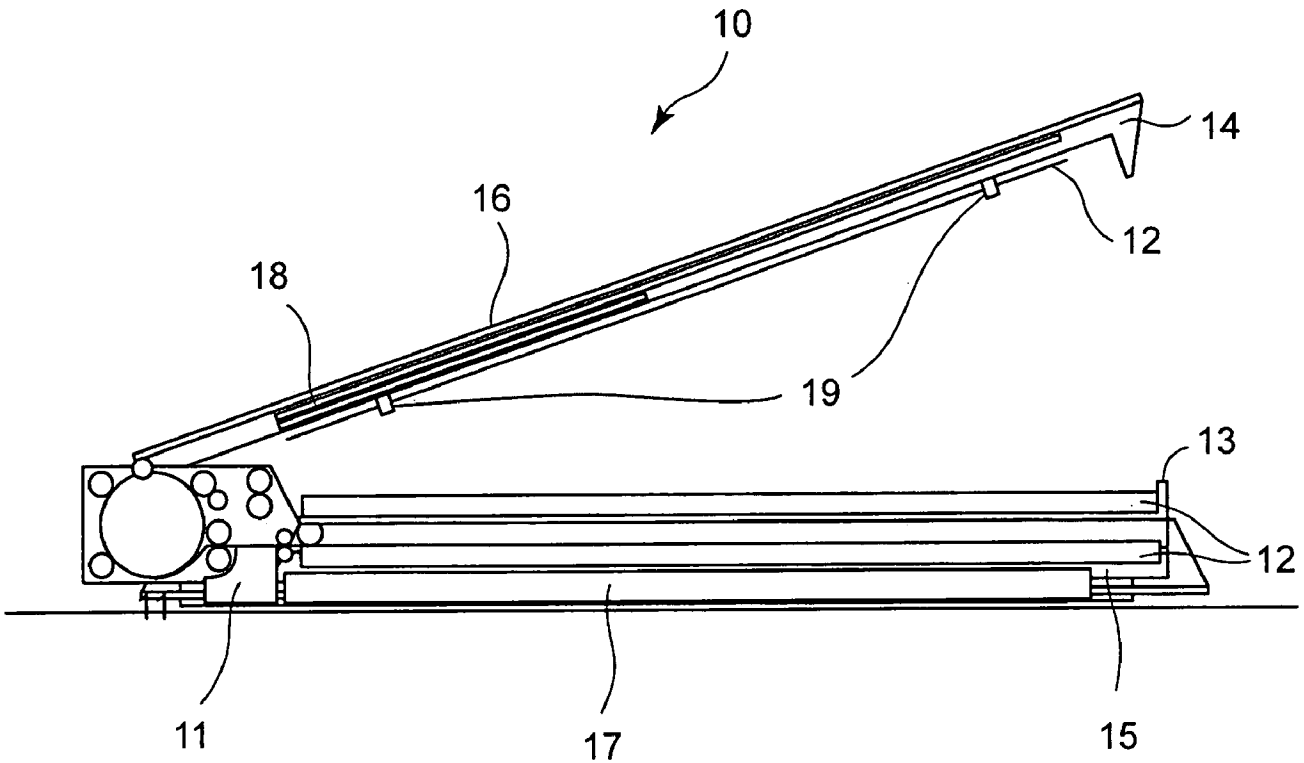
FIG. 3 is a cross-sectional view of the ink-jet printer in a state in which a cover is open.

FIG. 3 is a cross-sectional view of the ink-jet printer 10 in a state in which the cover 14 is open.

Cut sheets 12 stacked in the container 13 can be taken out by opening the cover 14, as shown in FIG. 3.

A cut sheet on which a desired image is printed is sometimes disposed in the lower part of the stack of cut sheets 12 in the container 13. Accordingly, the ink-jet printer 10 has sorting members 19 for sorting the cut sheets 12. The sorting members 19 are claws that are to be placed between stacked cut sheets. When the cover 14 is opened, the sorting members 19 hold, on the back side of the cover 14, all cut sheets stacked on the desired cut sheet. Therefore, the desired cut sheet is placed at the uppermost position when the cover 14 is opened, and can be easily taken out.

Figure 4:
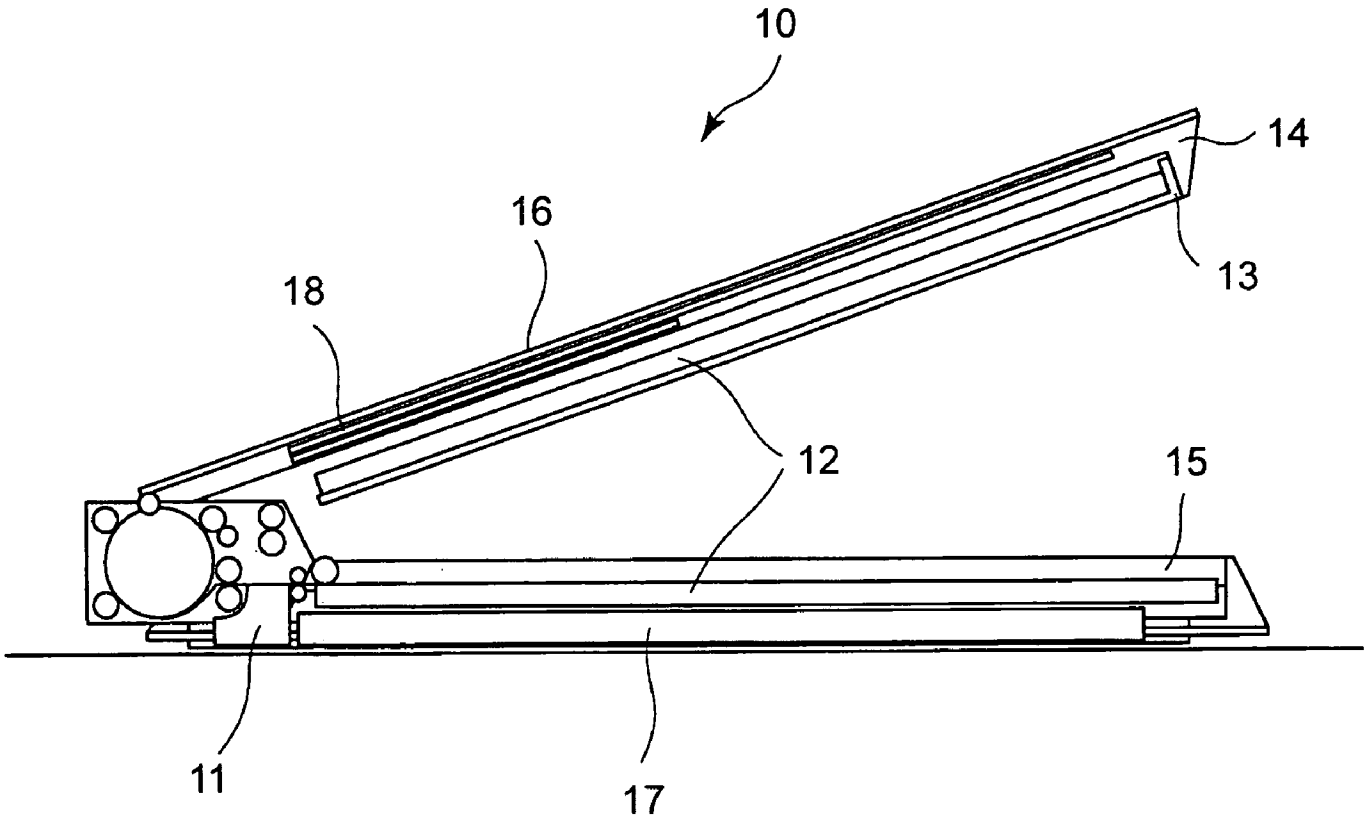
FIG. 4 is a cross-sectional view of the ink-jet printer in a state in which a container that constitutes an ejection tray is open.

FIG. 4 is a cross-sectional view of the ink-jet printer 10 in a state in which the container 13 that constitutes the ejection tray is open.

As shown in FIG. 4, the supply tray 15 and the ejection tray (container 13) placed one on the other can be separated from each other. For this reason, when the ejection tray is opened, cut sheets can be added into the supply tray 15.

Figure 5:
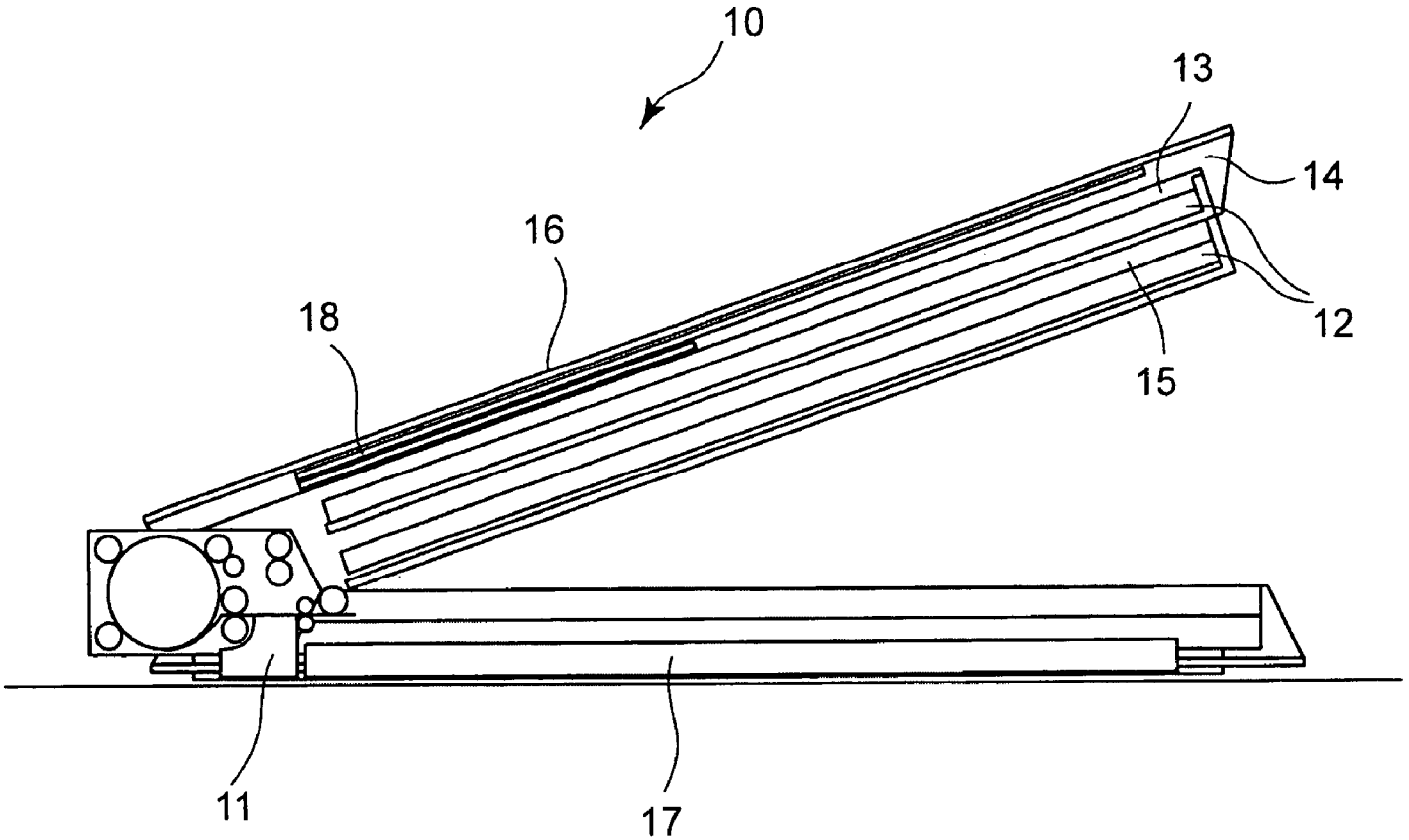
FIG. 5 is a cross-sectional view of the ink-jet printer in a state in which a supply tray for recording sheets is open.

FIG. 5 is a cross-sectional view showing a state in which the supply tray 15 is open.

As shown in FIG. 5, the supply tray 15 and the ink cartridge 17 placed one on the other can be separated from each other. For this reason, when the supply tray 15 is opened, ink can be added into the ink cartridge 17 (or the ink cartridge 17 can be replaced with another).

Figure 6:
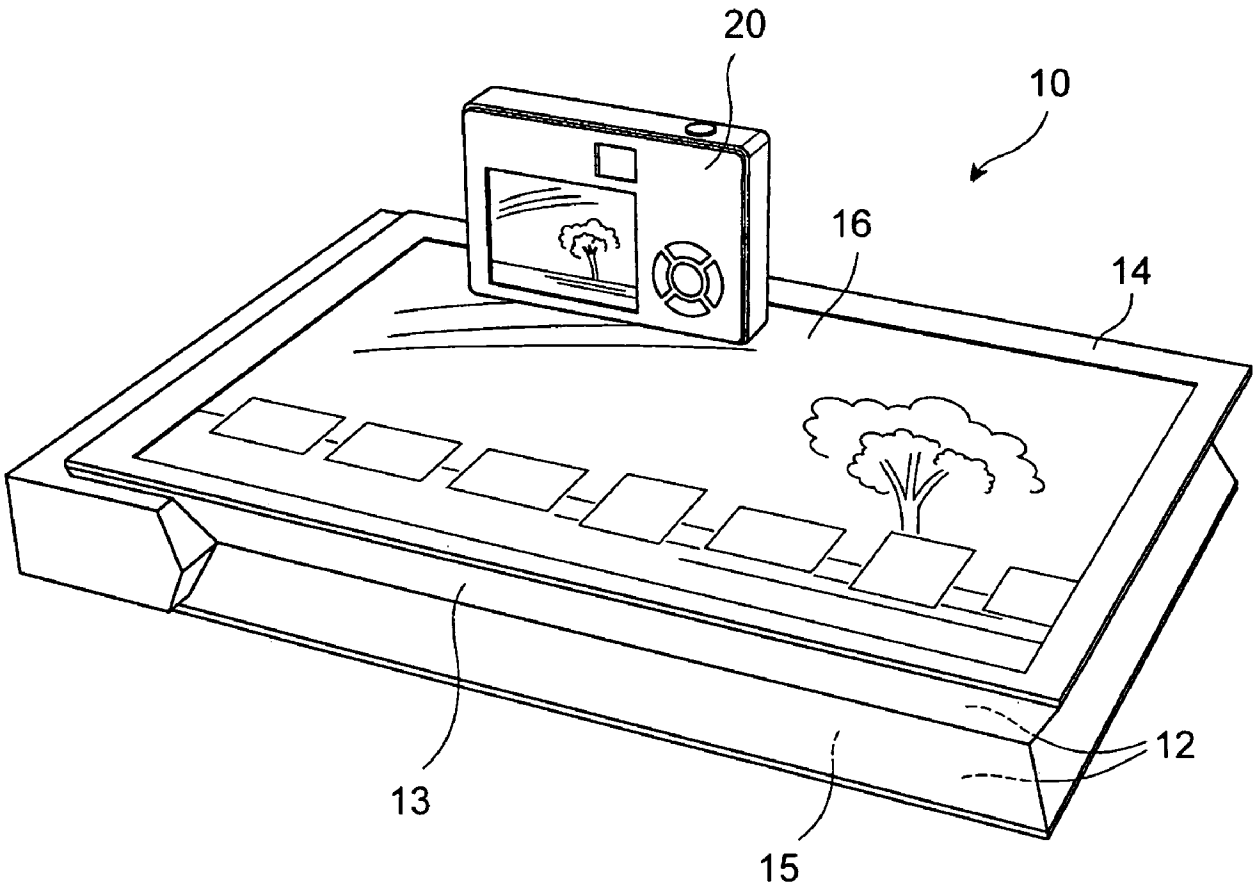
FIG. 6 is a cross-sectional view of the ink-jet printer in a state in which information is displayed on the cover.

FIG. 6 is a perspective view of the ink-jet printer 10 in a state in which information is displayed on the cover 14.

As shown in FIG. 6, the liquid crystal display 16 having a touch panel function is provided on the cover 14. Therefore, picture images are sent to the ink-jet printer 10 in a wireless manner and are stored in the memory of the ink-jet printer 10 by simply placing a digital camera 20 on the liquid crystal display 16. The digital camera 20 may be placed at any position on the liquid crystal display 16. When the digital camera 20 is placed, picture images are sent automatically.

While picture images are being sent, an image displayed on a liquid crystal display of the digital camera 20 is also displayed in a full-screen manner on the liquid crystal display 16, as shown in FIG. 6.

Images that have been sent and stored in the memory of the ink-jet printer 10 are displayed on the liquid crystal display 16 in thumbnail form (enclosed by rectangles).

The images thus sent to the ink-jet printer 10 and stored in the memory can be printed on cut sheets 12 supplied from the supply tray 15. By clicking any of the thumbnail images displayed on the liquid crystal display 16 and selecting printing, printing is performed. That is, the liquid crystal display 16 displays information images corresponding to information that can be printed on the cut sheets 12. After printing, the cut sheets 12 are stacked in the container 13.

In a different display mode, the liquid crystal display 16 displays information printed on the cut sheets 12 by the ink-jet head 11. That is, displayed thumbnail images correspond to images printed on the cut sheets 12. Any of the thumbnail images may be clicked so as to be selectively displayed in a full-screen manner on the liquid crystal display 16.

Consequently, in the ink-jet printer 10 of this embodiment, all images printed on the cut sheets 12 can be displayed on the liquid crystal display 16, and can be inspected without taking out the cut sheets 12 from the container 13. That is, the ink-jet printer 10 corresponds to the information display device.

When any of the thumbnail images displayed on the liquid crystal display 16 is selected by clicking, and the cover 14 is then opened, a desired cut sheet on which the selected image is printed can be taken out easily. That is, all other cut sheets stacked on the desired cut sheet are held on the back side of the cover 14 by the sorting members 19 (see FIG. 3). Therefore, the desired cut sheet is placed at the uppermost position in the container 13 when the cover 14 is opened.

In the ink-jet printer 10 of this embodiment, images printed on cut sheets by the ink-jet head 11 are displayed on the liquid crystal display 16 in this way. For this reason, the printed images can be inspected without taking out the cut sheets from the container 13.

By simply opening the cover 14 after clicking and selecting any of thumbnail images displayed on the liquid crystal display 16, a cut sheet on which the selected image is printed is taken out easily.

While the embodiment of the present invention has been described above, the present invention is not limited to the embodiment, and the following modifications are possible:

(1) While the ink-jet printer 10 is described as an example of an image forming apparatus in the above embodiment, the present invention is also applicable to other image forming apparatuses such as printers, copying machines, and facsimile apparatuses.

(2) While the line-type ink-jet head 11 performs printing in the above embodiment, a serial ink-jet head may be used. Ink may be discharged by any method, for example, thermal discharging, electrostatic discharging, or piezoelectric discharging. Instead of the ink-jet head, for example, a thermal transfer head may be used for printing.

(3) While the liquid crystal display 16 serves as the display for displaying information in the above embodiment, it may be replaced with other displays such as an organic EL (electroluminescence) display. Information to be displayed is not limited to images, and may include, for example, characters.

(4) In the above embodiment, the liquid crystal display 16 having a touch panel function is used to display information, and selection from the information images is made by a click operation. Alternatively, another display device having a touch panel function and an operating unit for selection from the information images may be provided separately.

(5) While the ink cartridge 17 is provided under the supply tray 15 in the above embodiment, it may be provided on the supply tray 15 and under the ejection tray (container 13 and cover 14). In this case, the ink cartridge 17 is replaced with another one or ink is added into the ink cartridge 17 in a state in which the ejection tray is opened. Cut sheets are added into the supply tray 15 in a state in which the ejection tray and the ink cartridge 17 are opened.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus comprising:

a printing unit for performing printing on a recording sheet;

a supply tray from which the recording sheet is supplied; and an ejection tray including a container that contains the recording sheet after printing, and a movable cover mounted on the container, wherein the recording sheet supplied from the supply tray is ejected into the container after being subjected to printing by the printing unit, and wherein the ejection tray is separably disposed on the supply tray to form a stack, addition of another recording sheet into the supply tray is allowed when the supply tray and the ejection tray are separated, and the recording sheet contained in the container is allowed to be taken out when the cover is opened, wherein the cover has a display that displays an information image corresponding to information printed on the recording sheet by the printing unit.

2. An image forming apparatus comprising:

a printing unit for performing printing on a recording sheet;

a supply tray from which the recording sheet is supplied; and an ejection tray including a container that contains the recording sheet after printing, and a movable cover mounted on the container, wherein the recording sheet supplied from the supply tray is ejected into the container after being subjected to printing by the printing unit, and wherein the ejection tray is separably disposed on the supply tray to form a stack, addition of another recording sheet into the supply tray is allowed when the supply tray and the ejection tray are separated, and the recording sheet contained in the container is allowed to be taken out when the cover is opened, wherein the recording sheet includes a plurality of recording sheets, the ejection tray has a sorting member for sorting the recording sheets stacked in the container, the cover has a display that displays information images corresponding to information printed on the recording sheets by the printing unit, and has a touch panel function, and the recording sheets are sorted in the container according to section from the information images displayed on the display.

* * * * *